US010857061B2

(12) United States Patent
Alexander

(10) Patent No.: US 10,857,061 B2
(45) Date of Patent: Dec. 8, 2020

(54) NECK TREATMENT DEVICE

(71) Applicant: Mark Alexander, Victoria (AU)

(72) Inventor: Mark Alexander, Victoria (AU)

( * ) Notice: Subject to any disclaimer, the term of this patent is extended or adjusted under 35 U.S.C. 154(b) by 0 days.

(21) Appl. No.: 15/529,480

(22) PCT Filed: Nov. 20, 2015

(86) PCT No.: PCT/IB2015/059017

§ 371 (c)(1),
(2) Date: May 24, 2017

(87) PCT Pub. No.: WO2016/083968

PCT Pub. Date: Jun. 2, 2016

(65) Prior Publication Data

US 2017/0258667 A1 Sep. 14, 2017

(51) Int. Cl.

| | |
|---|---|
| ***A61H 7/00*** | (2006.01) |
| ***A47G 9/10*** | (2006.01) |
| ***A47C 7/38*** | (2006.01) |
| ***A61H 1/00*** | (2006.01) |

(52) U.S. Cl.

CPC ..... *A61H 7/001* (2013.01); *A47C 7/383* (2013.01); *A47G 9/10* (2013.01); *A61H 1/008* (2013.01); *A61H 2201/1292* (2013.01); *A61H 2203/0425* (2013.01); *A61H 2203/0456* (2013.01)

(58) Field of Classification Search

CPC . A61H 7/007; A61H 7/00; A47G 9/10; A47G 9/1081; A47G 9/109; A47G 9/1009; A47G 2009/1018

USPC ..... D24/183, 184; D6/601

See application file for complete search history.

(56) References Cited

U.S. PATENT DOCUMENTS

| | | | | | |
|---|---|---|---|---|---|
| 4,320,543 | A | * | 3/1982 | Dixon | A47G 9/1081 5/636 |
| 4,432,107 | A | * | 2/1984 | Clark | A47G 9/1081 5/636 |
| 4,777,855 | A | * | 10/1988 | Cohen | A47G 9/10 5/636 |
| 4,832,007 | A | * | 5/1989 | Davis, Jr. | A47G 9/1081 250/580 |
| 4,918,774 | A | * | 4/1990 | Popitz | A47G 9/10 5/636 |
| D310,610 | S | * | 9/1990 | Dixon | D6/601 |
| 5,007,633 | A | | 4/1991 | Lemire | |
| D325,839 | S | * | 5/1992 | Main | D6/601 |

(Continued)

OTHER PUBLICATIONS

International Search Report for Application No. PCT/IB2015/059017, dated Feb. 2, 2016, 4 Pages.

(Continued)

*Primary Examiner* — Michael J Tsai

(74) *Attorney, Agent, or Firm* — Eandi Fitzpatrick LLP; William Fitzpatrick

(57) ABSTRACT

Neck treatment devices for treating the neck of a person is disclosed herein. The treatment devices have front to back treatment elements with multiple extending ridges located in spaced apart side by side relationship extending substantially in parallel from, at or towards the front edge of treatment element to the back edge of treatment element with a relatively gentle sloping curve in their front portion and a more pronounced curve in their back portion. A method of using the neck treatment device is also disclosed.

3 Claims, 9 Drawing Sheets

(56) References Cited

U.S. PATENT DOCUMENTS 5,163,194 A * 11/1992 Dixon ..... A47G 9/1081 5/636
5,220,700 A * 6/1993 Liu ..... A47C 7/383 5/636
D363,403 S * 10/1995 Dixon ..... 5/636
D370,066 S * 5/1996 Kennemore ..... D24/183
5,533,218 A * 7/1996 Fahy ..... A47C 27/144 5/421
5,542,910 A * 8/1996 Oliver ..... A47G 9/1009 5/622
D377,729 S * 2/1997 Bonaddio ..... D6/596
D386,643 S * 11/1997 Farrell ..... D6/596
5,682,633 A * 11/1997 Davis ..... A47G 9/1081 5/636
D390,404 S * 2/1998 Hargest ..... D6/596
5,722,102 A * 3/1998 Summers ..... A47C 7/425 297/452.29
5,727,267 A * 3/1998 Keilhauer ..... A47G 9/109 5/632
5,743,271 A * 4/1998 Royo-Salvador ..... A47G 9/10 128/845
D394,977 S * 6/1998 Frydman ..... D6/596
5,799,344 A 9/1998 Najar
D404,239 S * 1/1999 Denney ..... D6/601
D455,311 S * 4/2002 Fux ..... D6/601
D497,507 S * 10/2004 Keilhauer ..... D6/601
7,089,615 B1 * 8/2006 Parimuha ..... A47G 9/10 5/636
7,331,631 B1 * 2/2008 Yeh ..... A47C 7/38 297/391
8,015,640 B2 * 9/2011 Sun ..... A47G 9/10 5/636
8,650,684 B1 * 2/2014 Mackinnon ..... A61G 13/1215 5/637
D716,072 S * 10/2014 Rose ..... D6/601
2008/0155754 A1 * 7/2008 Desjarlais ..... A61G 7/072 5/652
2009/0145442 A1 * 6/2009 Hecox ..... A47G 9/1009 128/845
2011/0094033 A1 * 4/2011 Lee ..... A61F 5/56 5/636
2012/0024295 A1 * 2/2012 Mihin ..... A61F 5/3707 128/845
2013/0161997 A1 6/2013 Ciepiela
2013/0283534 A1 10/2013 Marinkovic
2013/0313881 A1 11/2013 Kao
2015/0265793 A1 * 9/2015 Davis ..... A47C 20/04 128/202.18
2016/0114708 A1 * 4/2016 Spalter ..... A47C 7/383 297/397

OTHER PUBLICATIONS

Written Opinion of the International Searching Authority for Application No. PCT/IB2015/059017, dated Feb. 2, 2016, 5 Pages.

* cited by examiner

NECK TREATMENT DEVICE

CROSS-REFERENCE TO RELATED APPLICATION

This application claims the benefit of Australian Provisional Application No. 2014904824, filed Nov. 28, 2014.

FIELD OF THE INVENTION

The present invention relates to devices for treating the neck by relieving pain and stiffness and reducing muscle tension in the neck of a person.

BACKGROUND OF THE INVENTION

Many members of the population suffer from back and neck problems. One source of neck problems experienced by such people is caused by poor postures from prolonged sitting in office chairs at work or whilst driving cars for extended periods or when relaxing at home in poorly supporting chairs, such as lounge chairs. The back, or spine, of the person when sitting in a chair rests in a concave or slouched shape in which the shoulders tend to be in a rounded position extending slightly forwardly of the chest portion of the person, and the head of the sitting person tends to extend slightly forwardly of the neck of the person, with the chin of the sitting person tending to be poked forward, which is not a position that is conducive to maintaining a good posture. Slouching places the passive structures of the neck, such as for example, facet joints and discs, in a more or less continually compressed position, which can lead to pain caused by the continual compression. In particular, the longer a person sits in a chair in a slouched position with their head and chin poked forward, the longer and larger are the forces that are placed upon the neck which in turn results in there being a greater tendency for pain to develop in the neck. This force over time compresses the passive structures of the spine which in turn, leads to the development of neck pain and also headaches arising from the compression and/or misalignment of the upper three neck or cervical vertebra.

Slouching also places the neck muscles, such as the upper cervical extensors (rectus capitus posterior minor and major, obliquus capitus superior and inferior), in a more or less continually shortened position, which can lead to pain caused by their continual shortened length. In particular, the longer a person sits in a chair in a slouched position with their head and chin poked forward, the longer the neck muscles are in a shortened position which in turn results in there being a greater tendency for pain to develop in the neck and the muscles to permanently shorten. This force over time shortens the passive structures of the spine which, in turn, can also lead to the development of head aches arising from the upper three neck or cervical vertebra.

Therefore, there is a need for a device that people with neck problems, such as for example, neck pain and stiffness, muscle tension, muscle tightness and/or headaches can use to relieve their pain, stiffness, tension, tightness and/or headaches which addresses the problems caused by slouching when seated in a chair or seat.

Accordingly, it is an aim of the present invention to provide a device that people with neck pain and stiffness, muscle tension, muscle tightness and/or headaches can use in supine lying which is configured so as to address the problem of neck pain and stiffness, and shortened muscles developing caused by slouching when sitting in a chair.

Another way of describing the deleterious effects of slouched posture is how it relates to the structure and architecture of the spine and the problems that cause painful conditions in the spine. In healthy individuals, or at least in individuals having good posture, the spine, particularly the cervical spine (neck), has a curve or is curved inwardly, which is referred to as the lordotic curve or lordosis. When slouched sitting occurs, there is a tendency for the neck of the person to increase the lordosis, which leads to facet joint compression and muscle shortening that allows the onset of conditions in the neck which develop pain, damage and injury. Thus, there is a need for a device that reverses, or at least reduces, the joint stiffness and muscle shortening that develops when a person sits in the chair in a slouched position with increased cervical lordosis, particularly for extended periods, by applying direct therapeutic mobilising force to the neck joints and muscles from the weight of the head and neck of the person when lying in a supine position resting upon the neck treatment device.

Accordingly, it is an aim of the present invention to provide a neck treatment device that can relieve pain, reduce joint stiffness, muscle tightness and/or tension, and/or relieve headaches, and/or allow users to maintain a good normal posture of the neck, after use.

Accordingly, it is an aim of the present invention to provide a method of treating a person suffering from neck pain using a neck treatment device to reduce or ameliorate such pain.

Accordingly, it is an aim of the present invention to provide a method of using a neck treatment device to ameliorate neck pain.

SUMMARY OF THE INVENTION

According to one aspect of the present invention, there is provided a neck treatment device comprising a first neck treatment element having multiple first treatment ridges for treating a first side of the neck of a person on, at or towards one side of a central spinal portion of the neck, a second neck treatment element having multiple second treatment ridges for treating a second side of the neck of a person on, towards or at the other side of the central spinal portion of the neck, the first neck treatment element being spaced apart from the second neck treatment element to define a receiver therebetween for at least in part receiving at least some of the central spinal portion of the neck (spinous processes) wherein the first and second multiple neck treatment ridges are arranged to extend outwardly in profile from the respective neck treatment elements to an extent to direct posterior to anterior forces within the neck region onto the cervical (neck) facet joints and muscles of a person lying supine on the neck treatment device to mobilise the neck joints of the person when in a stationary (sustained) position, or to mobilise the neck joint by movement if the person moves their head and neck, the muscles of the person receiving direct therapeutic massaging force, and wherein both the multiple first neck treatment ridges has a first innermost ridge and a first outermost ridge, and the second neck treatment ridges has a second outermost ridge and a second innermost ridge such that the ridges are arranged concavely in front view with the first and second outermost ridges extending higher than the first and second innermost ridges to an extent to uniformly match the convex shape of the head and neck of the user lying supine on the neck treatment device.

According to another aspect of the present invention, there is provided a method of using a neck treatment device or structure for treating a person suffering from a neck pain condition, comprising the steps of locating the neck treatment device on a substrate and positioning the neck of the person on the neck treatment device wherein the neck treatment device comprises a first neck treatment element having multiple first treatment ridges, including a first innermost ridge and a first outermost ridge, for treating the neck of a person on, at or towards a first side of a central spinal portion of the neck, a second neck treatment element having multiple second treatment ridges including a second outermost ridge and a second innermost ridge for treating the neck of a person on, towards or at a second side of the central spinal portion of the neck, the first neck treatment element being spaced apart from the second neck treatment element to define a receiver therebetween for receiving at least some of the central spinal portion of the neck (spinous processes) wherein the multiple first and second ridges are arranged to extend outwardly in profile from the neck treatment device to an extent to direct posterior to anterior forces onto the cervical (neck) facet joints and muscles of a person lying supine on the neck treatment device to mobilise the neck joints of the person when in a stationary (sustained) position, or to mobilise the neck joint with movement when the person moves their head and neck, the muscles of the person receiving direct therapeutic massaging force, and wherein the multiple first ridges and the multiple second ridges are arranged concavely in front view with the respective outermost ridges extending higher than the respective innermost ridges to an extent to uniformly match the convex shape of the head and neck of the user lying supine on the device thereby treating the neck condition.

According to another aspect of the present invention, there is provided a chair having a chair back and a chair seat, the chair back being provided with a neck treatment device for relieving pain and supporting the neck of an occupant when seated on the seat portion of the chair with the neck in contact with the neck treating device, the said neck treatment device comprising a first neck treatment element with multiple first treatment ridges including a first outermost ridge and a first innermost ridge, for treating the neck of a person on, at or towards a first side of a central spinal portion of the neck, a second neck treatment element with multiple second treatment ridges including a second outermost ridge and a second innermost ridge for treating the neck of a person on, at or towards a second side of the central spinal portion of the neck, the first neck treatment element being spaced apart from the second neck treatment element to define a receiver therebetween for receiving at least some of the central spinal portion of the neck (spinous processes) wherein the multiple first and second neck treatment elements are arranged to extend outwardly in profile from the neck treatment device to an extent to direct posterior to anterior forces onto the cervical (neck) facet joints and muscles of a person lying supine on the neck treatment device to mobilise the neck joints of the person when in a stationary (sustained) position, or to mobilise the neck joints with movement when the person moves their head and neck, the muscles of the person receiving direct therapeutic massaging force, and wherein the multiple first ridges and the multiple second ridges are arranged concavely in front view with the respective outermost ridges extending higher than the respective innermost ridges to an extent to uniformly match the convex shape of the head and neck of the user lying supine on the device.

According to another aspect of the present invention, there is provided a method of relieving and reversing pain and/or joint stiffness and/or muscle tightness and/or muscle tension and/or injury to the neck of a person suffering from a neck condition, the method comprising the steps of locating a neck treatment device on a suitable substrate and positioning the neck of the person on the device, the device comprising a first neck treatment element with multiple first treatment ridges including a first outermost ridge and a first innermost ridge for treating the neck of a person on, at or towards a first side of a central spinal portion of the neck, a second neck treating element having multiple second treatment ridges including a second outermost ridge and a second innermost ridge for treating the neck of a person on, towards or at a second side of the central spinal portion of the neck, the first neck treatment element being spaced apart from the second neck treatment element to define a receiver therebetween for receiving at least some of the central spinal portion (spinous processes) of the neck wherein the multiple first and second ridges are arranged to extend outwardly in profile from the neck treatment device to an extent to direct posterior to anterior forces onto the neck joints and muscles of a person lying supine on the neck treatment device to mobilise the neck joints of the person when in a sustained position, or to mobilise the neck joints of the person by movement if the person moves their head and neck, by the muscles of the person receiving direct therapeutic massaging force, and wherein the multiple first treatment ridges and the multiple second neck treatment ridges are arranged concavely in front view with the respective outermost ridges of the first and second treatment ridges extending higher than the respective innermost ridges to an extent to uniformly match the convex shape of the head and neck of the user lying supine on the device thereby treating the neck.

In one form, the present invention relates to devices for treating the neck of a person to relieve pain and reduce joint stiffness and muscle tension when lying supine (face upwards) on the device under the person's neck.

In one form, the present invention relates to a neck treatment device that relieves pain and reduces joint stiffness and muscle tightness and tension, and headaches by directing forces directly onto the cervical (neck) facet joints and muscles.

In one form, the present invention relates to devices that improve the posture of the neck of the person when the person is in a seated position, such as when sitting on a chair.

The present invention finds particular application as a neck treatment device for use on the floor to assist a person who is lying supine to relieve neck pain and stiffness and muscle tension by directing forces directly onto the neck facet joints and muscles in a posterior to anterior direction through the weight of the head and neck (as generated by gravity) of the user resting on the device.

Although the present invention will be described with particular reference to one or more forms of the neck treatment device and the treatment elements forming the neck treatment device, optionally incorporated into a chair, it is to be noted that the scope of the protection is not restricted to the described embodiment or embodiments but rather the scope of the protection is more extensive so as to include other arrangements and forms of the neck treatment device, of the neck treatment device elements and their various individual components and to the use of the various members and elements in other arrangements including, but not limited, to chairs and for other purposes.

In one form, the neck treatment device comprises two neck treatment elements, each element having multiple ridges in spaced apart relationships to one another, typically three individually identifiable ridges. Typically, one neck treatment element with multiple ridges is located to one side of the centre line of the neck treatment device and the other neck treating element with multiple ridges is located to the other side of the centre line of the neck treatment device. In one form, the neck treatment device is symmetrical about the central longitudinal axis.

In one form, each of the neck treatment elements are curved or arcuate in the depthwise front to rear extending direction of the device. In one form, the curve is an asymmetrical curve having a more gentle curve located at or towards the front and a more pronounced curve located at or towards the front.

In one form, the curve of the neck treatment device treatment elements is a simple curve, a complex curve, a compound curve, or a variable curve over the front to back depth of the element.

In one form, each individual ridge comprised within the neck treatment elements is convexly curved in frontal section. More typically, the convex curve is achieved by a variety of different shapes, amounts of outward extensions, projections or the like. Typically, convex inducing shapes are elliptical, semi-circular, hemispherical, rectilinear, rounded rectilinear, trapezoidal, or of any other curved shape or the like.

In one form, the ridges comprised within the neck treatment elements are arranged in a concave shape in the frontal plane with outermost ridges being higher top to bottom than the lower innermost ridges.

In one form, the neck treatment elements are generally ribs, bulges, protuberances, projections, humps, ridges, elongate knobs, bosses, tubes, rods, pipes, hoses or similar outwardly extending structures. In one form, the ridges are solid whereas in other forms, the ridges are hollow. If hollow, the treatment device and ridges are adapted to receive fluids therein, such as for example, heated fluids to provide therapeutic treatment for the back, particularly for the relief of pain or cooling fluids to increase comfort of the user of the device, or to receive a vibrating apparatus to relieve pain and increase comfort of the user of the device. In one form, the ridges are filled with a gel or gel-like material, or other fluid to impart resilience and/or flexibility to the ridges or to improve the feel or touch appeal of the device.

In one form, the neck treatment device elements extend continuous in the depthwise front to back extending direction. In other forms, the ridges are discontinuous in the depthwise extending axis being made from a multitude of discrete portions or sections such as for example blocks, lumps, knobs or other discrete shaped portions or segments arranged collinearly in longitudinally spaced apart relationship to one another to provide support for respective side portions of the neck on either side of the spine.

In one form, the surface of the neck treatment elements is smooth. Alternatively, the surface of the neck treatment elements is uneven, patterned, irregular, textured or the like by being provided with projecting portions and trough portions in various combinations such as islands in the sea, or sea in island combinations or the like. In one form, the projections are in the form of knobs, protrusions, spikes, tubes, columns, collars, ribs, flutes, or other shaped projections for contacting the side portions of the neck to support the neck and/or to increase comfort of using the neck treatment device of the present invention.

In one form, the neck treatment device treatment elements are movable such as to provide a massaging effect on the back. In this form, the movement of the various sections of the neck treatment device elements are controlled by electrically powered motors. Typically, the various parts of the ridges are controllably moved in sequence so as to massage the back, such as for example in pulses, waves, rhythms and the like.

Forms of the neck treatment device can be incorporated into the back of a chair, bench or seat or other suitable support structure. In one form, the neck treatment device is in the form of an insert that is locatable on the back of a chair. In one form, the insert is a replaceable insert. In one form, the neck treatment device is a part of the chair back, including having fixed elements or interchangeable elements or the like.

Forms of the neck treatment device are incorporated into the chair during manufacture whereas other forms of the neck treatment device are a retro fit that can be fitted to the rear of the chair after purchase, such as for example, the entire chair back can be replaced or only a section of the chair back can be replaced with a corresponding section containing the treatment device, and/or the forwardly extending ridges only can be fitted, replaced, exchanged or the like.

The neck treatment device applies direct pressure, and/or mobilises, and/or manipulates, and/or massages, and/or pushes on, the facet joints in the cervical spine (neck) of a person using the device. In order to effectively relieve pain and joint stiffness, the neck treatment device elements need to apply pressure to the facet joints. However, almost all currently or previously available neck treatment devices not in accordance with the present invention, do not have specific multiple treatment elements that are anatomically matched to the average human cervical neck facet joint positions and therefore do not apply sufficient therapeutic direct pressure to the facet joints. By providing a device with specific multiple treatment elements that are anatomically matched to the average human cervical neck facet joint positions, direct pressure can be applied to the facet joints thereby relieving or reducing the pain produced in the neck of a person. The treatment elements of the present invention apply direct pressure to the cervical neck facet joints and relieve pain and stiffness.

In one form, the central receiver of the neck treatment device is a groove, channel, valley, rebate, slot, depression, lengthwise extending cavity, elongate void or similar formed between the two spaced apart ridges, pipes or other projections of the neck treating elements. The central spinous processes of the neck which are the bones in the centre of the spine which can be readily felt under the skin in this region, are received into the receiver intermediate the two adjacent ridges for comfort of the user by reducing direct pressure on the spine and also forcing the user to lie centrally on the floor on the treatment device with the central spinal portion located between the two inner most projecting ridges on either side of the device. The multiple projecting ridges on either side of the central receiver will contact the erecter spinai and upper cervical extensor muscles on either side and/or adjacent to the spine and apply pressure to the cervical facet joints thereby relieving pain in the person's neck through the direct pressure being applied.

In one form, when the device is part of or fitted to a chair, the multiple ridges are contours which protrude from a chair back having the appearance of multiple ridges running longitudinally in the upper portion of the back of a chair such as for example, extending substantially vertically. The ridges will structurally be convex compared to the normal concavity of the back of a chair. This arrangement applies direct pressure to the user's neck muscles and joints.

In one form, the spacing apart of the multiple raised treatment elements in the form of contours, ridges, humps, from the centerline of one to the centre line of the other will be as per FIG. 4 from:

Innermost treatment elements from the centre (FIGS. 4 10A and 10B): about 5 mm to about 45 mm, preferably from about 10 mm to about 40 mm, more preferably from about 15 mm to about 35 mm, and most preferably from about 25 mm to about 30 mm, and the most preferable being about 27.75 mm.

Middle treatment elements (FIGS. 4 12A and 12B): about 35 mm to about 90 mm, preferably from about 45 mm to about 80 mm, more preferably from about 55 mm to about 70 mm, and most preferably from about 60 mm to about 65 mm, and the most preferable being about 62 mm.

Outermost treatment elements from the centre: (FIGS. 4 14A and 14B): about 70 mm to about 130 mm, preferably from about 80 mm to about 120 mm, more preferably from about 90 mm to about 110 mm, and most preferably from about 95 mm to about 105 mm, and the most preferable being about 101 mm.

In one form, the ridges forming the neck treatment device elements extends from the remainder of the device over a range of from about 2 mm to about 15 mm, preferably from about 4 mm to about 10 mm, and more preferably about 6 mm to about 8 mm.

The distances between, and also the shapes, of the neck treatment elements provide direct pressure onto the neck facet joints and muscles when supine lying on the device which leads to pain relief, reduction in stiffness and muscle tightness and tension which assists in preventing the development of further neck pain and injury occurring from prolonged forces being placed upon the neck joints, discs, ligaments and muscles from slouched postures. When the direct pressure from the neck treatment elements is applied to the upper cervical (neck) joints and extensor muscles, especially where they attach to the base of the skull (occiput), this can lead to relief of headaches, muscle trigger points and muscle tightness.

The neck treatment device applies direct pressure to the joints and muscles of the cervical (neck) spine of a person. The distances between the neck treatment elements ensures direct pressure is applied to the actual facet joints of the cervical (neck) spine when the user is lying supine on the neck treatment device. In order to relieve pain originating from the cervical (neck) joints, direct mobilising pressure must be applied to the facet joints. However, almost all currently or previously available neck treatment devices not in accordance with the present invention, provide only general diffuse forces on to the neck, and not direct forces onto the cervical (neck) facet joints as the neck treatment elements are not of the exact spacing apart to match the distance between the cervical (neck) facet joints. By providing a neck treatment device with treatment elements that are spaced apart to match the distance between the facet joints, the treatment elements provide direct forces onto the cervical (neck) facet joints thereby relieving pain and muscle tightness in the neck of a person.

BRIEF DESCRIPTION OF THE DRAWINGS

The present invention will now be described by non-limiting example with reference to the various embodiments as shown in the accompanying drawings in which.

DETAILED DESCRIPTION OF THE INVENTION

Figure 1:
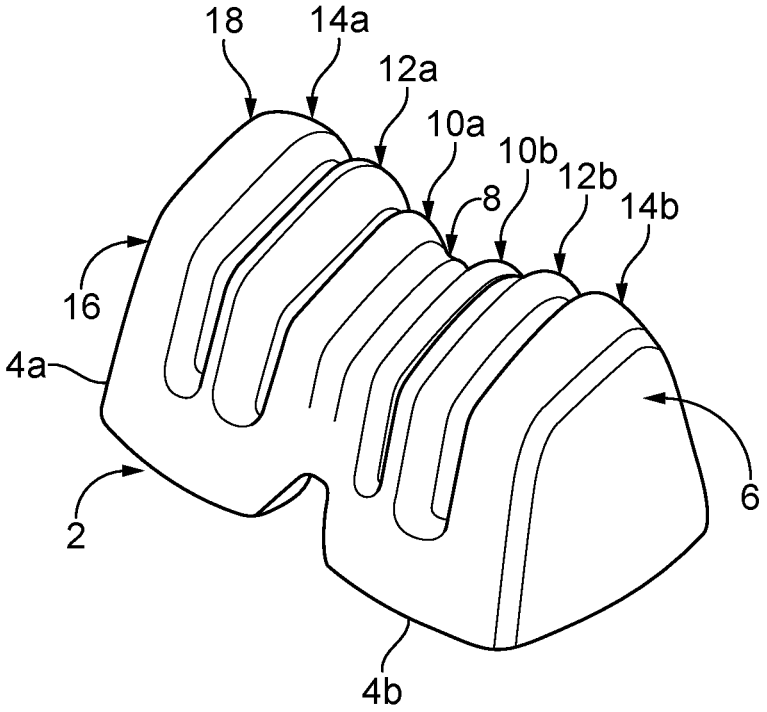
FIG. 1 is a perspective view of one form of a neck treatment device.

In FIG. 1 is shown one form of a neck treatment device, generally denoted as 2, having two opposed and identical side sections 4*a*, 4*b* located on either side of the device.

Side portion 4*b* includes neck treatment elements in the form of multiple ridges, generally denoted as 6.

Figure 6A:
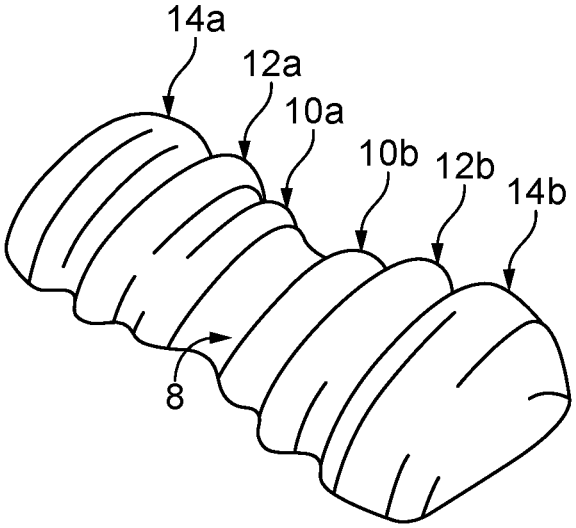
FIGS. 6*a* and 6*b* are schematic perspective views of two different other forms of the neck treatment device.
Figure 6B:
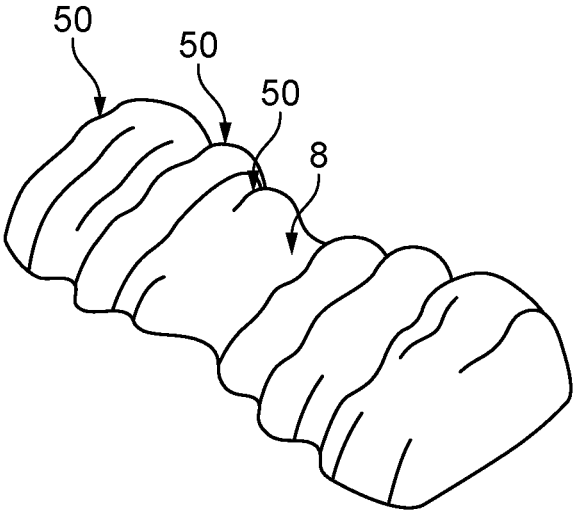
Figure 8:
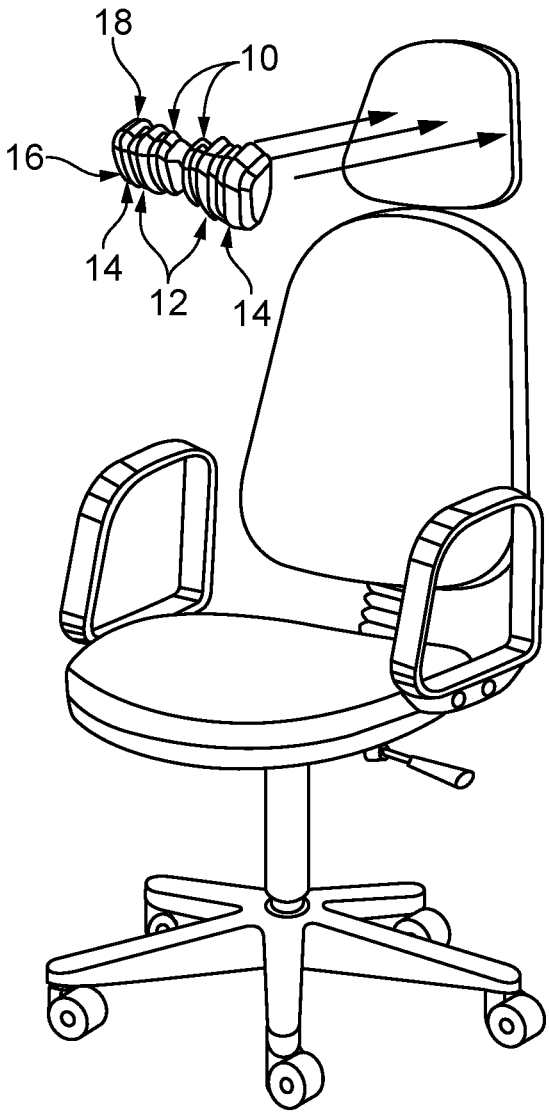
FIG. 8 is a perspective view of one form of a chair having one form of the treatment device attached to the headrest of the chair.
Figure 9A:
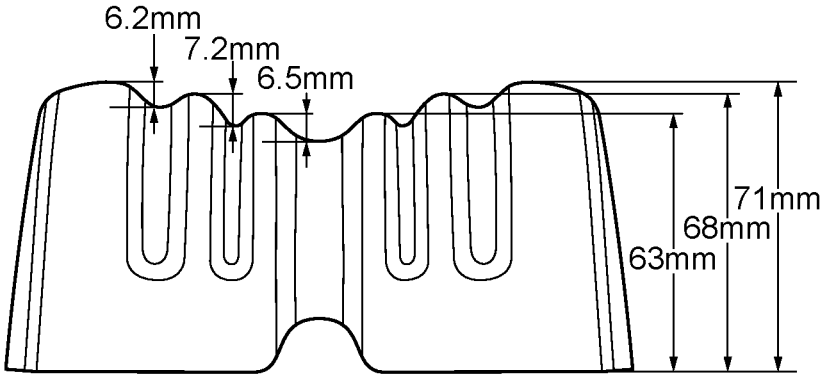
FIG. 9 includes views showing selected measurements, of one form of the neck treatment device.
Figure 9B:
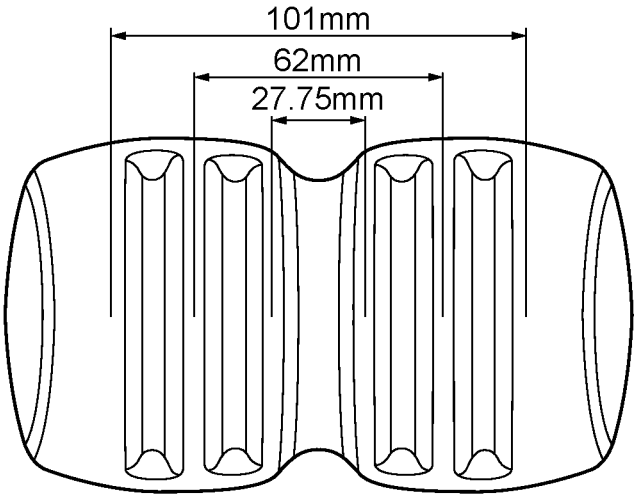

Ridges 6 can be formed integrally with the device 2 or can be in the form of a panel or insert, similar to that shown in FIGS. 6*a*, 6*b*, and 8, or can be an insert for attaching to the top face of device 2, or be in any other form.

One form of the treatment elements includes outwardly extending ridges 10*a*, 10*b*, 12*a*, 12*b* and 14*a*, 14*b* located in spaced apart side by side relationship to one another extending substantially in parallel from, at or towards the front edge 16 of the treatment portion to the back edge 18 of the treatment portion in the upper portion of device 2. Although one form of the treatment elements is shown in the form of six ridges, it is to be noted that the number of ridges can take any suitable number, distribution, type or the like.

Figure 2:
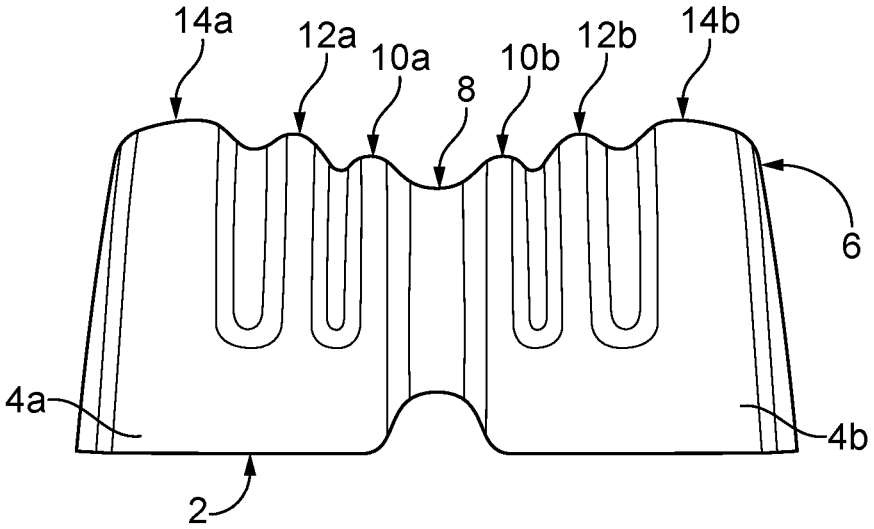
FIG. 2 is a front view of the neck treatment device of FIG. 1.
Figure 3:
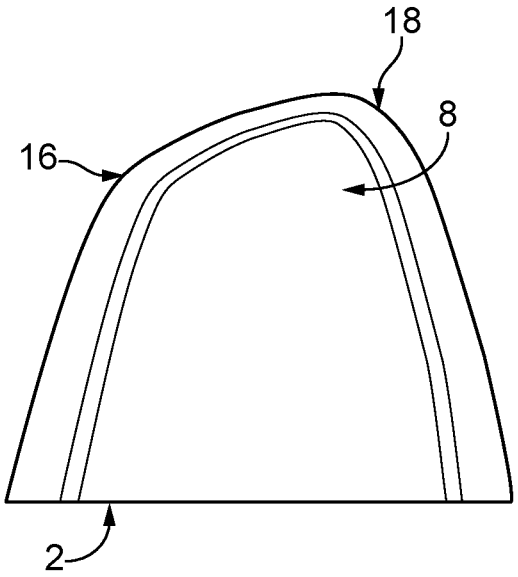
FIG. 3 is a side elevation view of the neck treatment device of FIG. 1.
Figure 4:
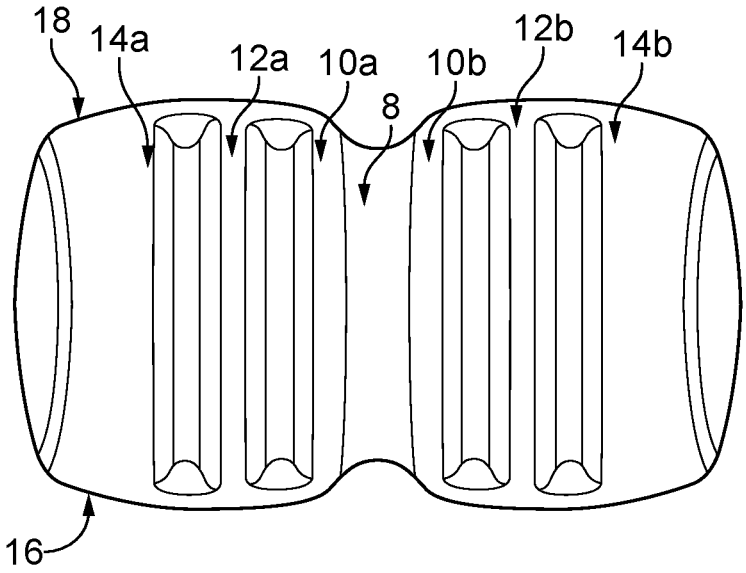
FIG. 4 is a top plan view of the neck treatment device of FIG. 1.

Ridges 10, 12 and 14 are each generally curved in profile as best illustrated in FIG. 2 such as for example, having a relatively gentle sloping curve in their front portion 16 and a more pronounced curve in their rear back portion 18 for providing less or more pressure to the cervical (neck) facet joints respectively when lying on the device supine. However, as will be described below, ridges 10, 12, and 14 can have any suitable profile.

A receiver in the form of a valley 8 is formed between the two centre ridges 10*a* and 10*b*. Valley 8 is for receiving the spinous processes of the cervical spine to help locate the neck correctly in the centre of treatment portion 6 and to assist in providing comfort for the spine when a person lies supine on device 2. The cervical (neck) facet joints of the person rest on the ridges 10, and 12, and the remainder of the neck, and occasionally the base of the skull (occiput) of the person rests against the ridge 14.

Owing to the width between the projections of the upwardly facing parts of each ridge 10,12, and 14, when a person lies on device 2 with their spine centrally located within valley 8, the presence of ridges 10 and 12 exert direct pressure onto the cervical (facet) joints on either side of the neck. When a person lies on device 2, the ridges 10 and 12 are contacting the erector spinai and upper cervical (neck) extensor muscles on either side or adjacent to the spine and apply pressure directly through to the cervical (neck) facet joints of the person so that the facet joints are therapeutically mobilised thereby relieving joint pain and stiffness, headaches, and cervical (neck) muscles are massaged and thereby relieving muscle tightness, tension, and headaches.

As illustrated in the frontal view shown in FIG. 2, ridges 10, 12 and 14 are generally arranged in a concave arrangement in frontal cross-section or front view as best illustrated in FIG. 2 where ridges 10*a*, 10*b* take the form of the innermost and lowest sections of the concave curve on each side of device 2, and ridges 14 take the form of the outermost and highest sections of the concave curve on either side of device 2. The concave arrangement allows for uniform matching of the convex shape of the head and neck when resting on the neck treatment device treatment element ridges. However, the ridges can have any suitable arrangement in the frontal view.

In one form, the neck treatment elements of the present invention are formed more or less as a one piece construction as shown in FIG. 1 or as an insert, or insertable panel as shown in FIGS. 6*a*, 6*b* and 8.

Figure 7A:
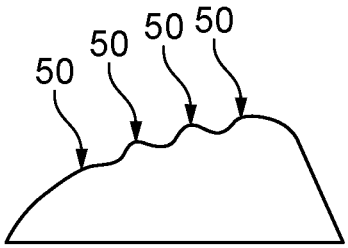
FIGS. 7*a, b, c, d, e* and *f* are schematic side elevation views of other forms of the neck treatment device showing different profiles of the neck treatment elements.

A modified form of the neck treatment device is the embodiment shown in perspective in FIG. 6*b* and in profile in FIG. 7*a* of the drawings, which embodiment has a similar construction to the embodiment of FIG. 1 and that illustrated in FIG. 6*a* except that ridges 10, 12, and 14, instead of being continuously curved ridges extending from the front edge 16 of treatment portion 6 to the back edge 18 of treatment portion 6, are arranged in separate discrete treatment nodules 50 in generally spaced apart relationship to one another in the front to back direction.

In FIG. 6*b*, treatment elements 50 can have any suitable shape or profile provided the two sets of treatment elements on either side of valley 8 combine to produce a mobilising force to the cervical (neck) facet joints. In one form, the blocks 50 can be of a generally rounded shape as shown generally in FIGS. 1, 6*a*, 6*b*, and 7*a* whereas in another form, they could be rectangular, trapezoidal, knobs, spikes, triangular or square in profile or have any suitable shape.

Figure 7B:
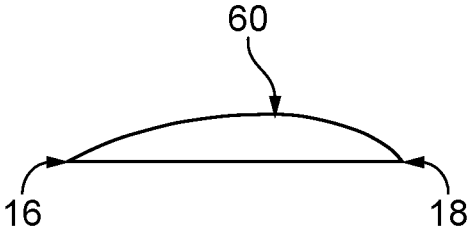

Another form of the treatment element 6 of the present invention is shown in FIG. 7*b*, where the ridges 10, 12, and 14 are each curved in profile as best illustrated in FIG. 7*b* such as for example, having a relatively symmetrical sloping curve 60 from their front 16 portion to their back 18 portion.

Figure 7C:
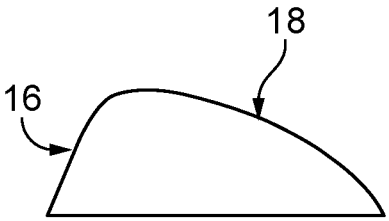

Another form of the treatment element 6 of the present invention is shown in FIG. 7*c*, where the ridges 10, 12, and 14 are each curved in profile as best illustrated in FIG. 7*c* such as for example, having a relatively gentle sloping curve in their back 18 portion and a more pronounced curve in their front 18 portion (reverse of FIG. 1).

Figure 7D:
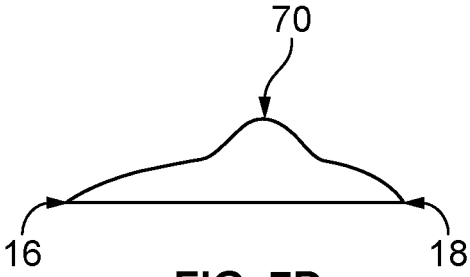

Another form of the treatment element 6 of the present invention is shown in FIG. 7*d*, where the ridges 10, 12, and 14 are each curved in profile as best illustrated in FIG. 7*d* such as for example, having a relatively symmetrical sloping curve from their front 16 portion to their back 18 portion but there is a more pronounced treatment element 70 in the midpoint of the front 16 and back 18 of the treatment element 6.

Figure 7E:
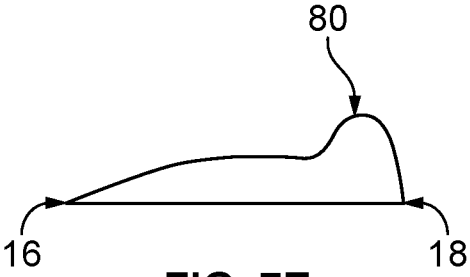

Another form of the treatment device is shown in FIG. 7*e* which has a relatively symmetrical sloping curve from front portion 16 to rear portion 18 but there is a more pronounced treatment element 80 in the rear portion 18 of the treatment element 6.

Figure 7F:
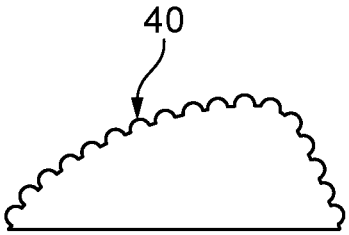

A further embodiment of the present invention is shown in FIG. 7*f* where ridges 10, 12, and 14 are provided with projections in the form of knobs 40 arranged over the surface of ridges 10, 12, and 14. Although one form of the projections is shown in the form of knobs, it is to be noted that the projections can take any suitable form, shape, distribution, type or the like.

Figure 5:
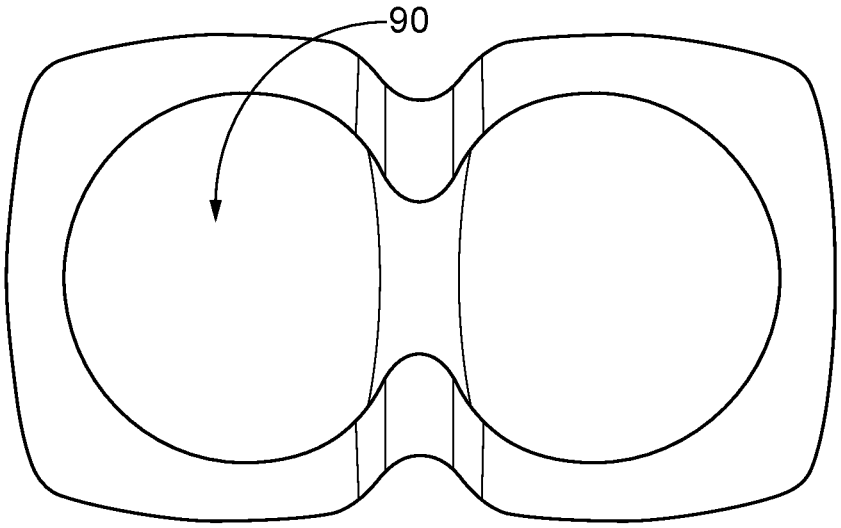
FIG. 5 is an underneath view of the neck treatment device of FIG. 1.

The bottom view shown in FIG. 5 can either be totally flat, or can have a hollow section 90 for conveying fluid or apparatus therethrough in the event that the treatment element is required to be heated, cooled, vibrated or the like.

The distance between the treatment elements of the neck treatment device, match the average distance between the cervical (neck) facet joints.

The valley present between the central two spaced-apart ridges on the treatment element portion of the device where the spinous processes sit, reduces the pressure applied to the spine as the spinous processes are not in contact with the device.

The user lies on the present invention in supine (face-up) and through the weight of the head and neck on top of the device forces, as generated by gravity, are applied directly to the cervical (neck) facet joints through the cervical (neck) muscles) in a posterior to anterior direction.

These forces applied to the facet joints and muscles relieve joint pain and stiffness, reduce muscle tension and trigger points, and relieve headaches, as per a therapeutic treatment from a health professional such as a Physical Therapist, Osteopath, Chiropractor, Massage Therapist. But this is in contrast to a treatment delivered by a health professional as the user can treat their own neck and control the forces applied to their neck in the comfort of their chosen surroundings.

The valley present between the central two spaced-apart ridges on the treatment element portion of the device where the spinous processes sit, reduces the pressure applied to the spine as the spinous processes are not in contact with the device.

These therapeutic treatment forces relieve the effects of poor slouched postures where the weight and gravitational forces acting on the neck are absorbed by the passive restraints of the spine, such as the joints, ligaments, muscles, discs and nerves which leads to the development of pain and injury or damage.

The described arrangement has been advanced by explanation and many modifications may be made without departing from the spirit and scope of the invention which includes every novel feature and novel combination of features herein disclosed.

Those skilled in the art will appreciate that the invention described herein is susceptible to variations and modifications other than those specifically described. It is understood that the invention includes all such variations and modifications which fall within the spirit and scope.

The invention claimed is:

1. A neck treatment device comprising:

a first neck treatment element having multiple first treatment ridges for treating a first side of the neck of a person on, at or towards one side of a central spinal portion of the neck;

a second neck treatment element having multiple second treatment ridges for treating a second side of the neck of a person on, towards or at the other side of the central spinal portion of the neck, the first neck treatment element being spaced apart from the second neck treatment element to define a receiver therebetween for at least in part receiving at least some of the central spinal portion of the neck;

wherein the multiple first and second neck treatment ridges are arranged to extend outwardly in profile from the respective neck treatment elements to an extent to direct posterior to anterior forces within the neck region onto the cervical facet joints and muscles of a person lying supine on the neck treatment device to mobilize the neck joints of the person when in a stationary position, or to mobilize the neck joint by movement if the person moves their head and neck, the muscles of the person receiving direct therapeutic massaging force; and wherein the multiple first neck treatment ridges has a first innermost ridge, a first middle treatment ridge, and a first outermost ridge, and the multiple second neck treatment ridges has a second outermost ridge, a second middle treatment ridge, and a second innermost ridge such that the first innermost ridge, first middle treatment ridge, and first outermost ridge is arranged concavely in front view with the first and second outermost ridges extending higher than the first and second innermost ridges and the first and second middle treatment ridge extend in between the height of the first and second innermost ridges and first and second outermost ridges relative to a base of the device to an extent to uniformly match the convex shape of the head and neck of the person lying supine on the neck treatment device;

wherein the multiple first treatment ridges and multiple second treatment ridges have a continuously upwardly sloping convex compound curve starting at a front portion and ending in a rear back portion relative the base, the sloping convex compound curve being more pronounced toward the rear back portion relative the front portion so that when the person lies supine the person has the ability provide less or more pressure to the cervical facet joints based person resting their head or neck on the front or the back portion;

wherein each of the first treatment ridges and each of the second treatment ridges are configured to engage the human neck cervical joints;

wherein the first and second innermost ridges are 25 mm to 30 mm from a center of the neck treatment device;

wherein the first and second middle treatment ridge, are 60 mm to 65 mm from the center of the neck treatment device other from the center;

wherein the first and second outermost ridges are 95 mm to 105 mm from the center of the neck treatment device wherein each of the first treatment ridges 4 mm to 10 mm; and wherein each of the second treatment ridges 4 mm to 10 mm.

2. A method of using a neck treatment device or structure for treating a person suffering from a neck pain condition, comprising:

locating the neck treatment device on a substrate; and positioning the neck of the person on the neck treatment device wherein the neck treatment device comprises a first neck treatment element having multiple first treatment ridges comprising a first innermost ridge, a first middle ridge and a first outermost ridge for treating the neck of a person on, at or towards a first side of a central spinal portion of the neck, a second neck treatment element having multiple second treatment ridges comprising a second outermost ridge, a second middle ridge and a second innermost ridge for treating the neck of a person on, towards or at a second side of the central spinal portion of the neck, the first neck treatment element being spaced apart from the second neck treatment element to define a receiver for receiving at least some of the central spinal portion of the neck wherein the multiple first and second treatment ridges are arranged to extend outwardly in profile from the neck treatment device to an extent to direct posterior to anterior forces onto the cervical facet joints and muscles of a person lying supine on the neck treatment device to mobilize the neck joints of the person when in a stationary position, or to mobilize the neck joint with movement when the person moves their head and neck, the muscles of the person receiving direct therapeutic massaging force;

wherein the multiple first treatment ridges and the multiple second treatment ridges are arranged concavely in front view with the respective outermost ridges extending higher than the respective innermost ridges and the first and second middle ridge extend in between the height of the first and second innermost ridges and first and second outermost ridges relative to a base of the device to an extent to uniformly match the convex shape of the head and neck of the person lying supine on the device thereby treating the neck condition;

wherein the multiple first treatment ridges and multiple second treatment ridges have continuously upwardly sloping convex compound curve starting at a front portion and ending in a rear back portion relative the base, the sloping convex compound curve being more pronounced toward the rear back portion relative the front portion so that when the person lies supine the person has the ability provide less or more pressure to the cervical facet joints based person resting their head or neck on the front or the back portion;

wherein each of the first treatment ridges and each of the second treatment ridges are configured to engage the human neck cervical joints;

wherein the first and second innermost ridges are 25 mm to 30 mm from a center of the neck treatment device;

wherein the first and second middle treatment ridge, are 60 mm to 65 mm from the center of the neck treatment device;

wherein the first and second outermost ridges are 95 mm to 105 mm from the center of the neck treatment device;

wherein each of the first treatment ridges 4 mm to 10 mm; and wherein each of the second treatment ridges 4 mm to 10 mm.

3. A chair having a chair back and a chair seat, the chair back being provided with a neck treatment device for relieving pain and supporting the neck of an occupant when seated on the seat portion of the chair with the neck in contact with the neck treatment device, the neck treatment device comprising:

a first neck treatment element with multiple first treatment ridges comprises a first outermost ridge, a first middle ridge and a first innermost ridge, comprising a second outermost ridge, a second middle ridge and a second innermost ridge for treating the neck of a person on, at or towards a first side of a central spinal portion of the neck; a second neck treatment element with multiple second treatment ridges for treating the neck of a person on, at or towards a second side of the central spinal portion of the neck, the first neck treatment element being spaced apart from the second neck treatment element to define a receiver therebetween for receiving at least some of the central spinal portion of the neck;

wherein the multiple first and second neck treatment elements are arranged to extend outwardly in profile from the neck treatment device to an extent to direct posterior to anterior forces onto the cervical facet joints and muscles of a person lying supine on the neck treatment device to mobilize the neck joints of the person when in a stationary position, or to mobilize the neck joints with movement when the person moves their head and neck, the muscles of the person receiving direct therapeutic massaging force, and wherein the multiple first treatment ridges and the multiple second treatment ridges are arranged concavely in front view with the respective outermost ridges extending higher than the respective innermost ridges and the first and second middle treatment ridge extend in between the height of the first and second innermost ridges and first and second outermost ridges relative to a base of the device to an extent to uniformly match the convex shape of the head and neck of the person lying supine on the device;

wherein the multiple first treatment ridges and multiple second treatment ridges have a continuously upwardly sloping convex compound curve starting at a front portion and ending in a rear back portion relative the base, the sloping convex compound curve being more pronounced toward the rear back portion relative the front portion so that when the person lies supine the person has the ability provide less or more pressure to the cervical facet joints based person resting their head or neck on the front or the back portion;

wherein each of the first treatment ridges and each of the second treatment ridges are configured to engage the human neck cervical joints;

wherein the first and second innermost ridges are 25 mm to 30 mm from a center of the neck treatment device;

wherein the first and second middle treatment ridge, are 60 mm to 65 mm from the center of the neck treatment device;

wherein the first and second outermost ridges are 95 mm to 105 mm from the center of the neck treatment device;

wherein each of the first treatment ridges 4 mm to 10 mm; and wherein each of the second treatment ridges 4 mm to 10 mm.

* * * * *